US005832899A

United States Patent [19]

Soteriou

[11] Patent Number: 5,832,899

[45] Date of Patent: Nov. 10, 1998

[54] INJECTOR

[75] Inventor: Cecilia Catherine Elizabeth Soteriou, Lyndhurst, England

[73] Assignee: Lucas Industries plc, England

[21] Appl. No.: 725,632

[22] Filed: Oct. 3, 1996

[30] Foreign Application Priority Data

Oct. 4, 1995 [GB] United Kingdom ..... 9520243

[51] Int. Cl.[6] ..... F02M 41/00

[52] U.S. Cl. ..... 123/456; 123/467

[58] Field of Search ..... 123/456, 467; 239/96, 585.1

[56] References Cited

U.S. PATENT DOCUMENTS

| | | | |
|---|---|---|---|
| 3,777,977 | 12/1973 | Regneault et al. | 239/96 |
| 3,913,537 | 10/1975 | Ziesche et al. | 239/96 |
| 4,046,112 | 9/1977 | Deckard | 239/96 |
| 4,566,416 | 1/1986 | Berchtold . | |
| 4,572,433 | 2/1986 | Deckard | 239/96 |
| 5,287,838 | 2/1994 | Wells | 123/467 |
| 5,438,968 | 8/1995 | Johnson et al. | 123/467 |
| 5,441,028 | 8/1995 | Felhofer | 123/467 |
| 5,458,103 | 10/1995 | Lauvin | 123/467 |
| 5,511,528 | 4/1996 | Iwanaga et al. | 123/467 |
| 5,529,024 | 6/1996 | Wirbeleit et al. | 239/96 |

FOREIGN PATENT DOCUMENTS

| | | |
|---|---|---|
| 2 145 081 | 2/1973 | France . |
| 1 397 114 | 6/1975 | United Kingdom . |

*Primary Examiner*—Thomas N. Moulis
*Attorney, Agent, or Firm*—Andrus, Sceales, Starke & Sawall

[57] ABSTRACT

A fuel injector for use in conjunction with a common rail supply system comprises a nozzle within which a valve element is slidable. The valve element includes a thrust surface to which fuel is supplied from a source of fuel at high pressure through a supply passage. The pressure controller in the form of a restrictor is located in the supplied passage so that, in use, during injection the fuel pressure applied to the thrust surface falls to a level lower than that prior to injection.

4 Claims, 1 Drawing Sheet

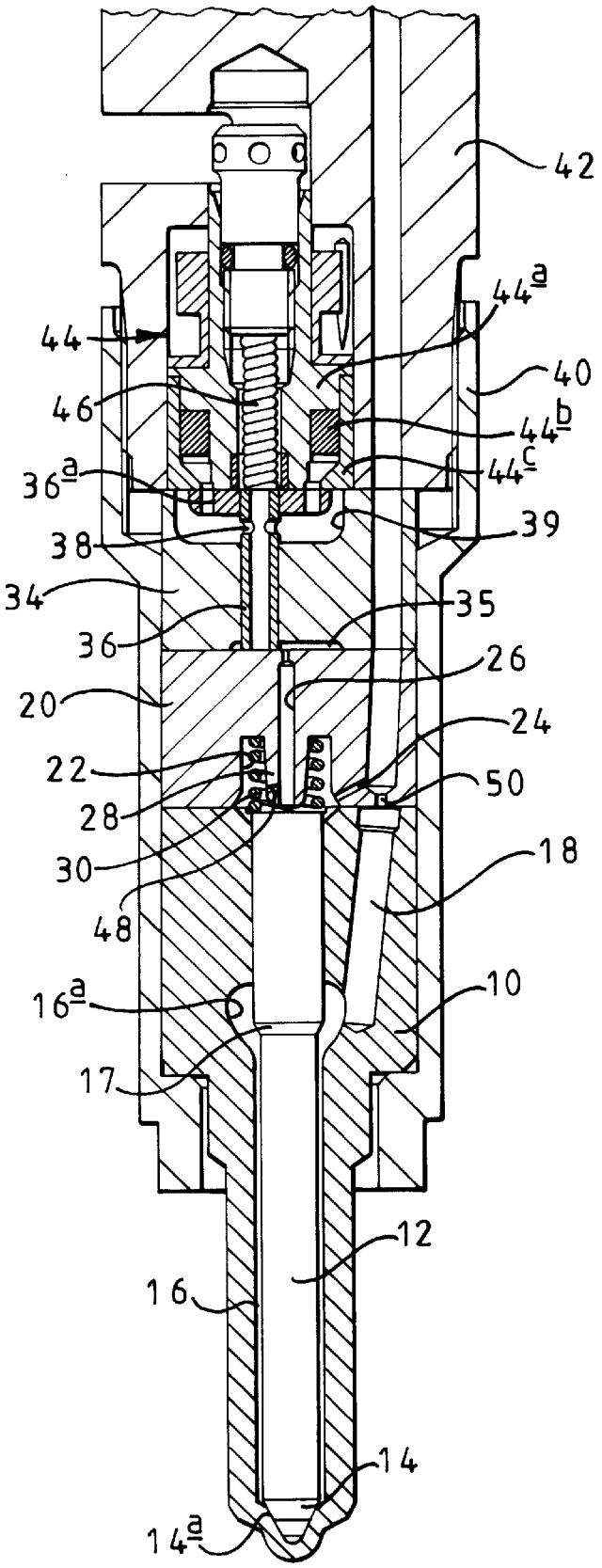
42
44a
44
40
46
44b
36a
44c
39
38
34
35
36
26
20
24
22
50
28
30
18
48
10
16a
17
12
16
14
14a

INJECTOR

This invention relates to an injector, in particular to an injector for use in a common rail injector arrangement.

In a common rail injector system, an accumulator is charged to high pressure by a suitable pump, and high pressure fuel from the accumulator is delivered through a control valve arrangement to the injectors of an associated engine, in turn. The injectors each include a valve element engageable with a valve seat such that when engaged with the valve seat, fuel is not permitted to flow through the injector to the respective cylinder, and upon being lifted from the valve seat, such flow is permitted.

Such injectors are preferably able to deliver very small amounts of fuel in a controlled manner, operate effectively under normal operating conditions, and open and close quickly on being activated.

According to the present invention there is provided an injector comprising a nozzle defining a valve seat, a valve element engageable with the seat, the valve element including a thrust surface, and a supply passage for supplying fuel towards the valve seat, the fuel flowing past the thrust surface, in use, wherein a pressure controller is provided and arranged such that, in use, the pressure of the fuel acting on the thrust surface is controlled.

The pressure controller preferably takes the form of a flow controller provided in the supply passage and arranged such that, in use, when fuel flows along the supply passage, a pressure differential is generated between a part of the supply passage upstream of the flow controller and a part of the supply passage downstream of the flow controller. The provision of such a pressure controller results in the application of a reduced pressure to the thrust surface whilst fuel flows along the supply passage.

The flow controller conveniently takes the form of a restriction, for example an orifice provided in the supply passage.

The provision of a restriction is advantageous in that it tends to damp the pressure wave which is transmitted along the fuel supply line from the accumulator to the injector valve. Such a pressure wave often arrives at the valve seat of the injector just before or during valve closure and may interfere with the termination of injection.

The provision of the pressure controller results in a reduction in the force acting against the thrust surface when the valve element is raised from the valve seat thus a smaller force is required to close the valve permitting a fast response. The increased speed of response results in a more positive termination of injection through a faster closure of the valve. It also results in a reduction in the minimum quantity of fuel which can be delivered in a controlled manner. Furthermore, the fast response enables the injector to be used where an initial pilot injection is required to be followed quickly by a main injection.

The invention will further be described, by way of example, with reference to the accompanying drawing which is a cross-sectional view of part of an injector in accordance with an embodiment of the invention.

The fuel injection nozzle illustrated in the accompanying drawing is intended for use with a common rail type fuel system and comprises a nozzle body 10 including a first region of relatively narrow diameter and a second, enlarged region. The body 10 is provided with a bore 16 which extends through both the first and second regions, the bore terminating at a position spaced from the free end of the first region. An elongate valve needle 12 is slidable within the bore 16, the valve needle 12 including a tip region 14 which is arranged to engage a valve seat defined by the inner surface of the body 10 adjacent the blind end of the bore 16. The body 10 is provided with one or more apertures communicating with the bore 16, the apertures being positioned such that engagement of the tip 14 with the valve seat prevents fluid escaping from the body 10 through the apertures, and when the tip 14 is lifted from the valve seat, fluid may be delivered through the apertures.

The valve needle 12 is shaped such that the region thereof which extends within the first region of the body 10 is of smaller diameter than the bore 16 to permit fluid to flow between the valve needle 12 and the inner surface of the body 10. Within the second region of the body 10, the valve needle 12 is of larger diameter, substantially preventing fluid flowing between the valve needle 12 and the body 10.

In the second region of the body 10, an annular gallery 16*a* is provided, the annular gallery 16*a* communicating with a fuel supply line 18 which is arranged to receive high pressure fuel from an accumulator of an associated fuel delivery system. The part of the valve needle 12 extending within the gallery 16*a* includes an annular, tapered, thrust surface 17 against which the fluid within the gallery 16*a* acts to tend to lift the valve needle 12 such that its tip 14 is lifted from the valve seat.

The tip 14 further includes a tapered thrust surface 14*a* against which the fluid acts to assist the thrust surface 17 in lifting the valve needle 12.

A first distance piece 20 is provided adjacent the second region of the body 10, the first distance piece 20 being provided with a chamber 22 which communicates with the high pressure fuel line 18 through a restricted passage 24. The chamber 22 is provided at an end of the first distance piece 20 and is closed by the body 10.

The first distance piece 20 includes a through bore 26 which extends along the axis of a projection 28 provided within the chamber 22. The projection 28 is arranged to guide a compression spring 30 which is engaged between an end face of the valve needle 12 and the first distance piece 20 to bias the valve needle 12 to a position in which the tip 14 thereof engages the valve seat.

A second distance piece 34 engages the side of the first distance piece 20 opposite that engaged by the body 10, the first and second distance pieces 20, 34 together defining a chamber 35 which communicates with the chamber 22 through the through bore 26. The second distance piece 34 is further provided with a bore which is spaced apart from the axis thereof and within which a valve member 36 is slidable. The valve member 36 comprises a cylindrical rod provided with an axially extending bore which is able to communicate with the chamber 35 when the valve member 36 is lifted such that a first end thereof is spaced from the first distance piece 20, such communication being broken when the valve member 36 engages the first distance piece 20. A pair of radially extending passages 38 communicate with the bore adjacent the second end thereof, the passages 38 communicating with a chamber 39 which is connected to a suitable low pressure drain.

The first and second distance pieces 20, 34 and the body 10 are mounted on a nozzle holder 42 by means of a cap nut 40 which engages the end of the second region of the body 10 adjacent its interconnection with the first region thereof. The holder 42 includes a recess within which a solenoid actuator 44 is provided.

The solenoid actuator 44 comprises a generally cylindrical core member 44*a*, windings 44*b* being wound upon the core member 44*a* and being connected to a suitable controller, and a cylindrical yoke 44*c* extending around the core member 44*a* and windings 44*b*. The faces of the core member 44*a* and yoke 44*c* facing the valve member 36 define pole faces.

The valve member 36 carries an armature 36*a* such that upon energization of the solenoid actuator 44, the armature 36*a* and valve member 36 are lifted such that the valve member 36 disengages the first distance piece 20. On de-energizing the solenoid actuator 44, the valve member 36 returns to its original position under the action of a spring 46 received within the blind bore of the core member 44*a*.

The supply line 18 comprises bores provided in the holder 42, the first and second distance pieces 20, 34 and body 10. In order to ensure that these bores align with one another, pins (not shown) are provided, the pins being received within suitable recesses provided in each of the holder 42, the first and second distance pieces 20, 34 and the body 10.

A restriction 50 is provided in the supply line 18 in the first distance piece 20 beyond the connection of the passage 24 to the supply line 18. The restriction 50 is intended to restrict the rate of flow of fuel to the gallery 16*a*.

In use, the supply line 18 is connected to a source of fuel at high pressure, and the valve needle 12 is biased by the spring 30 such that the tip 14 thereof engages the valve seat and thus delivery of fuel from the apertures does not occur. In this position, the pressure of fuel within the chamber 22 is high, and hence the force acting against the end of the valve needle 12 due to the fuel pressure, and also due to the resilience of the spring 30 is sufficient to overcome the upward force acting on the valve needle 12 due to the high pressure fuel acting against the angled thrust surfaces 14*a*, 17 of the valve needle 12.

In order to lift the tip 14 of the valve needle 12 away from the valve seat to permit fuel to be delivered from the apertures, the solenoid actuator 44 is energized to lift the valve member 36 against the action of the spring 46 such that the first end of the valve member 36 is lifted away from the first distance piece 20. Such lifting of the valve member 36 permits fuel from the chamber 35 and hence the chamber 22 to escape to drain through the bore of the valve member 36 and passages 38. The escape of fuel from the chamber 22 reduces the pressure therein, and due to the provision of the passage 24, the flow of fuel into the chamber 22 from the fuel supply line 18 is restricted. As the pressure within the chamber 22 falls, a point will be reached at which the force applied to the valve member 12 due to the pressure within the chamber 22 in combination with that applied by the spring 30 is no longer sufficient to retain the tip 14 of the valve member 12 in engagement with the valve seat, and hence a further reduction in pressure within the chamber 22 will result in the valve needle 12 being lifted to permit fuel to be delivered from the apertures.

As the valve needle 12 lifts, the end thereof approaches the projection 28 restricting the flow of fuel therethrough. It will be recognised that this has the effect of decelerating the valve needle 12 towards the end of its travel.

Prior to fuel delivery, the fuel pressure within the bore 16 and gallery 16*a* is relatively high, the pressure within the bore 16 and gallery 16*a* falling during delivery due to the flow of fuel out of the nozzle whilst the flow of fuel into the bore 16 is restricted by the restriction 50. However, the dimensions of the restriction 50 are chosen so as to permit the pressure of fuel to be maintained at a sufficiently high level that the forces acting on the thrust surfaces 14*a*, 17 are great enough to hold the valve needle 12 away from the valve seat against the action of the spring 30 and the pressure of fuel within the chamber 22.

In order to terminate delivery, the solenoid actuator 44 is de-energized and the valve member 36 moves downwards under the action of the spring 46 until the end thereof engages the first distance piece 20. Such movement of the valve member 36 breaks the communication of the chamber 35 with the drain, and hence the pressure within the chamber 35 and chamber 22 will increase, a point being reached at which the force applied to the valve needle 12 due to the pressure within the chamber 22 and due to the spring 30 exceeds that tending to hold the valve open, and hence the valve needle 12 will move to a position in which the tip 14 thereof engages the valve seat to prevent further delivery of fuel. It will be recognised that as the pressure within the bore 16 is relatively low compared to that before the commencement of delivery, such movement occurs relatively quickly after de-energization of the solenoid actuator 44 leading to the injector having a rapid response and a reduced minimum controllable quantity of fuel delivery. Further as the force tending to keep the valve needle 12 away from the seat is low, the risk of the valve failing to close is reduced.

Under normal circumstances, the end of the valve needle 12 is prevented from engaging the projection 28 by the flow of fuel through the bore 26 tending to push the valve needle 12 away from the projection 28. There is the risk, however, that if the end of the valve needle 12 engages the projection 28 thus preventing or restricting the flow of fuel through the bore 26, on de-energizing the solenoid actuator 44, the area of the valve needle 12 upon which the pressure of fuel within the chamber 22 acts is reduced, and hence there is the risk that the tip 14 of the valve needle 12 may remain lifted from the valve seat and so delivery of fuel from the apertures of the valve body 10 may not be terminated.

In order to reduce the risk of the valve needle 12 becoming stuck in the open position, a passage 48 is provided between the through bore 26 and the annular chamber 22 thus even when the end of the valve needle 12 engages the end of the projection 28, the through bore 26 is subject to substantially the same pressure as the annular chamber 22 and hence the part of the valve needle 12 which would otherwise be covered by the projection 28 is subject to substantially the same pressure as that portion of the valve needle 12 which is not covered by the projection 28.

In addition to the advantages described above, the provision of the restriction 50 also tends to damp pressure waves transmitted along the supply line 18 which could interfere with the injector valve closing.

The dimensions of the restriction 50 are largely dependent upon other parameters of the injector, and it will be understood that if the restriction 50 is too small, too great a force is applied to the valve needle 12 to close the valve as more fuel is supplied to the chamber 22 through the passage 24, and also fuel delivery is limited, whereas if the restriction 50 is too large, too much fuel is supplied to the gallery 16*a* thus the advantageous effects of the invention are reduced.

The effective area of the restriction 50 as defined by:

$$\text{effective area} = \frac{\frac{dQ}{dt}}{\sqrt{(P_1 - P_2)\frac{2}{\rho}}}$$

where:

$$\frac{dQ}{dt}$$

is the volumetric flow rate;

$P_1$ is the pressure upstream of the restriction 50;

$P_2$ is the pressure downstream of the restriction 50; and $\rho$ is the density of the fluid should fall within the range of approximately 1.6 to 3.2 times the effective area of the nozzle flow restriction (the combined effect of the restriction defined by the outlet apertures and the restriction due to the relatively small spacing of the tip 14 from the valve seat), the effective area of the nozzle flow restriction being defined by:

$$\frac{1}{A^2} = \frac{1}{A_1^2} + \frac{1}{A_2^2}$$

where:

A is the effective area of the nozzle flow restriction;

$A_1$ is the effective area of the restriction defined by the outlet apertures; and $A_2$ is the effective area of the restriction due to the small spacing of the tip 14 from the valve seat.

The effective area of the restriction 50 is preferably 1.8 to 2.5 times that of nozzle flow restriction mentioned hereinbefore, and is most preferably approximately 2.2 times that of the nozzle flow restriction.

I claim:

1. An injector for use in a common rail fuel system, the injector comprising a nozzle defining a valve seat, a valve element engageable with the seat, the valve element including a thrust surface, a chamber defined, in part, by a surface associated with the valve element oriented such that the application of fuel under pressure to the chamber applies a force to the valve element urging the valve element towards the valve seat, a control valve controlling the fuel pressure within the chamber, and a supply passage communicating, in use, with a source of fuel under high pressure, for supplying fuel from the source of fuel at high pressure towards the valve seat and the thrust surface, wherein a pressure controller in the form of a restriction is located in the supply passage and arranged such that, in use, when fuel flows along the supply passage, a pressure differential is generated between a part of the supply passage upstream of the restriction and a part of the supply passage downstream of the supply passage, the restriction being dimensioned to avoid restricting the rate at which fuel flows past the valve seat, in use, and to damp the transmission of pressure waves along the supply passage, and wherein the restriction has an effective area falling within a range of 1.6 to 3.2 times that of the nozzle flow restriction.

2. An injector as claimed in claim 1, wherein the restriction is of effective area falling within the range of 1.8 to 2.5 times that of the nozzle flow restriction.

3. An injector as claimed in claim 2, wherein the effective area of the restriction is equal to 2.2 times that of the nozzle flow restriction.

4. A common rail fuel supply system comprising a common rail, a fuel pump arranged to charge the common rail with fuel, and a plurality of injectors, each injector comprising a nozzle defining a valve seat, a valve element engageable with the seat, the valve element including a thrust surface, a chamber defined, in part, by a surface associated with the valve element oriented such that the application of fuel under pressure to the chamber applies a force to the valve element urging the valve element towards the valve seat, a control valve controlling the fuel pressure within the chamber, and a supply passage communicating, in use, with the common rail for supplying fuel from the common rail towards the valve seat and the thrust surface, wherein a pressure controller in the form of a restriction is located in the supply passage and arranged such that, in use, when fuel flows along the supply passage, a pressure differential is generated between a part of the supply passage upstream of the restriction and a part of the supply passage downstream of the supply passage, the restriction being dimensioned to avoid restricting the rate at which fuel flows past the valve seat, in use, and to damp the transmission of pressure waves along the supply passage, and wherein the restriction has an effective area falling within a range of 1.6 to 3.2 times that of the nozzle flow restriction.

* * * * *